US005644963A

United States Patent [19]

Fountas

[11] Patent Number: 5,644,963

[45] Date of Patent: Jul. 8, 1997

[54] ROOFING SHINGLE CUTTING GUIDE

[75] Inventor: Thomas A. Fountas, Racine, Wis.

[73] Assignee: George Seater, Jr., Racine, Wis.; a part interest

[21] Appl. No.: 650,100

[22] Filed: May 17, 1996

[51] Int. Cl.[6] ..... B26D 7/02

[52] U.S. Cl. ..... 83/454; 83/455; 83/468; 83/468.3; 83/581; 83/829

[58] Field of Search ..... 83/455, 468, 468.7, 83/581, 614, 648, 821, 829, 454, 761, 467.1, 468.1, 468.3; 269/303, 315, 319

[56] References Cited

U.S. PATENT DOCUMENTS

| | | | |
|---|---|---|---|
| 1,918,104 | 7/1933 | Hook | 83/468 |
| 2,531,149 | 11/1950 | Melchor | 83/455 |
| 4,128,118 | 12/1978 | Ede | 83/455 X |
| 4,354,410 | 10/1982 | Stubbings | 83/614 X |
| 4,510,834 | 4/1985 | Greene et al. | 83/581 X |
| 5,052,256 | 10/1991 | Morrissey | 83/468 |
| 5,086,680 | 2/1992 | Johnson | 83/614 X |
| 5,249,495 | 10/1993 | Renk | 83/468.7 X |

FOREIGN PATENT DOCUMENTS

| | | | |
|---|---|---|---|
| 0052018 | 5/1982 | European Pat. Off. | 269/319 |

*Primary Examiner*—Eugenia Jones
*Attorney, Agent, or Firm*—Ronald P. Brockman

[57] ABSTRACT

A guide apparatus for cutting roofing shingles includes a rigid base plate, substantially rectangular in shape, having a first end wall spaced from a second end wall; a first side wall spaced from a second side wall; a cutting guide pivotally supported on the base plate along the first side wall; and upright guide surfaces mounted for sliding movement on the base plate adjacent to the second side wall. The cutting guide may be fixed at non-perpendicular and perpendicular angles to the long axis of the base plate. A scale having reference markings for cutting shingles at predetermined lengths is mounted along the first side wall. The scale may be utilized to determine points at which the beginning and the end of a cut can occur both easily and accurately. A modification of the invention includes an outward extension of the base plate along the first side wall, the extension having an opening within it, the combination serving as a carrying handle for the guide apparatus.

6 Claims, 1 Drawing Sheet

ROOFING SHINGLE CUTTING GUIDE

This invention relates to devices for cutting sheet material, such as cardboard, paper, and roofing shingles, and more particularly to guides to be used for assisting such purposes.

BACKGROUND OF THE INVENTION

This invention relates to cutter work guides generally and more particularly pertains to shingle cutter work guides wherein the same is arranged for ease of manipulation and positioning of shingles relative to the cutting line when in use.

Asphalt shingles employed for roofing or siding are usually cut by a single blade knife. Frequently, it is necessary to cut the shingles at predetermined angles and, therefore, it is useful to provide a guide secured to the cutter which will position shingles in a plurality of positions for cutting and in which the guide may be fixed at any of several predetermined angles. This invention attempts to provide advantages of simplicity, compactness and ease of use.

SUMMARY OF THE INVENTION

The general purpose of this invention is to provide a new and improved cutter work guide which has all the advantages of prior art and none of the disadvantages. To achieve this the present invention provides a rigid base plate having a first end wall spaced from a second end wall, a first side wall and a second side wall, and an upright guide surface which is mounted along the second side wall for sliding movement. A cutting guide is pivotally attached along the first side wall of the base plate. A plurality of pins attached to the surface of the base plate align the cutting guide at predetermined angles. A scale on the device can be utilized for a rapid and accurate determination of points at which to cut the roofing shingles.

The invention resides not in any one of these features but in the particular combination of all of them.

It is among the objects and advantages of this invention to provide a cutter work guide which is provided with an adjustable pivotal guide arm adapted to position the guide arm at a plurality of predetermined angles relative to the long axis of the roofing shingle.

Another object of this invention is to provide a cutter work guide which is pivotally attached to the base plate and which is adapted with a handle which fixedly serves as a guard to the cutting blade of a cutting knife. Another object of this invention is to provide a cutter work guide which contains adjustable legs such that the working surface is horizontal while positioned on a sloped roof.

Other objects of the features and advantages of the invention will be apparent from the following more detailed description of the preferred embodiments of the invention as illustrated in the accompanying drawings.

BRIEF DESCRIPTION OF THE DRAWINGS

1.

2.

3.

DETAILED DESCRIPTION

Figure 1:
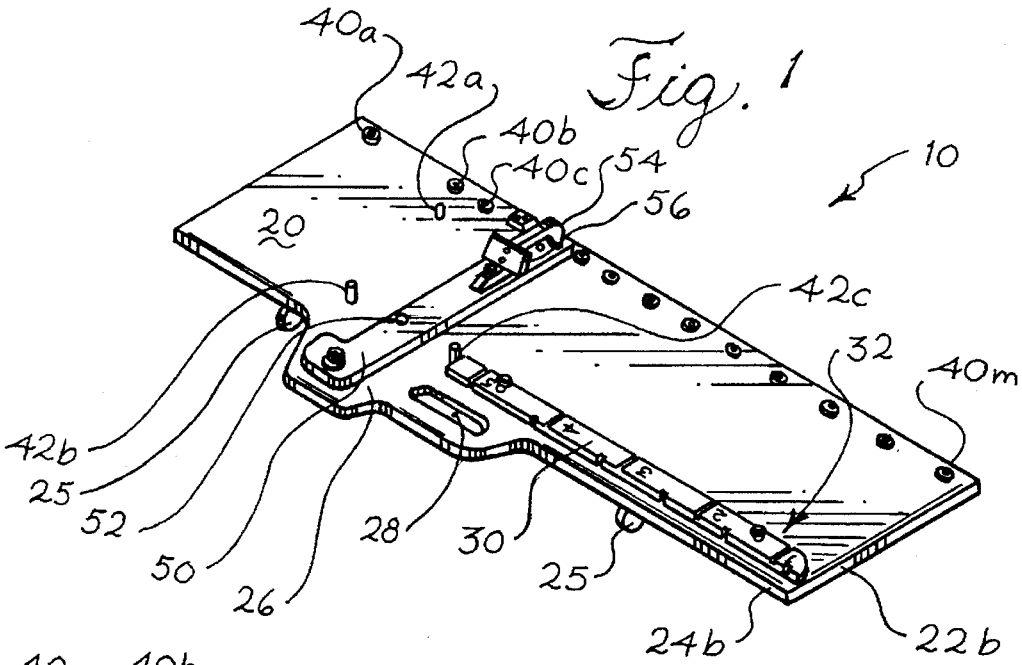
FIG. 1 is an isometric illustration of the cutter work guide of the present invention.

Referring to FIG. 1, the cutter work guide 10 consists of a rigid base plate 20 with first 22*a* and second 22*b* end walls; first 24*a* and second 24*b* side walls; first side wall 22*a* having an extension 26, which has a hole 28, the combination serving as a carrying handle for the invention. An upright guide surface 30 having a substantially upright surface 32 run along the base member near first end wall 22*a* for about half the length of the base member. In its preferred embodiment a scale is mounted on the upright guide surface 30. A plurality of discs 40*a–m* located along the second side wall 22*b* is fixedly attached in a line parallel to the second side wall 22*b*. The upright guide 30 and the pins 40*a–m* are appropriately placed so as to accommodate the width of the roofing shingle between them. A cutting guide 50 is pivotally attached to the base plate 20. A plurality of locator pins 42*a–c* are fixedly attached to the base plate 20 so as to fix the cutting guide 50 for predetermined angular cuts. The locator pins 42 may fix the cutting guide 50 by being positioned against it. This may also be accomplished by the placement of a pin into a suitably positioned hole 52 in the guide 50. In its preferred embodiment the cutting guide member has a handle 54 pivotally attached to it, which handle has a guard 56 to protect an operator's hand from a cutting knife blade which runs along the length of the cutting guide 50 during operation.

Figure 2:
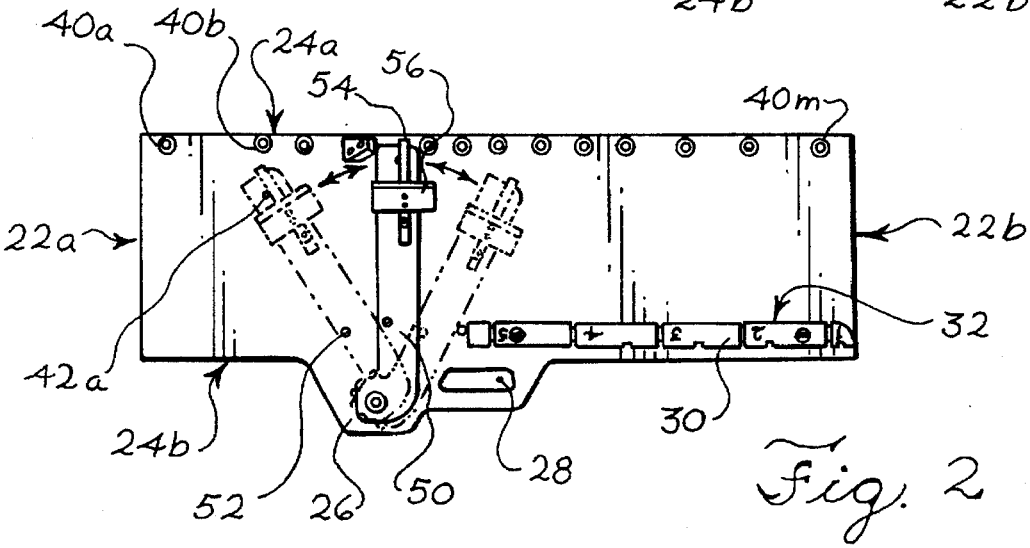
FIG. 2 is a top view of the cutter work guide of a preferred embodiment of this invention.

Referring to FIG. 2, the broken lines illustrate the cutting guide 50 in varying positions on the cutter guide 10. The cutting guide 50 is shown with pins 42 inserted in cutter guide hole 52 in the left position. In the right position it 50 rests against locator pin 42*c*.

Figure 3:
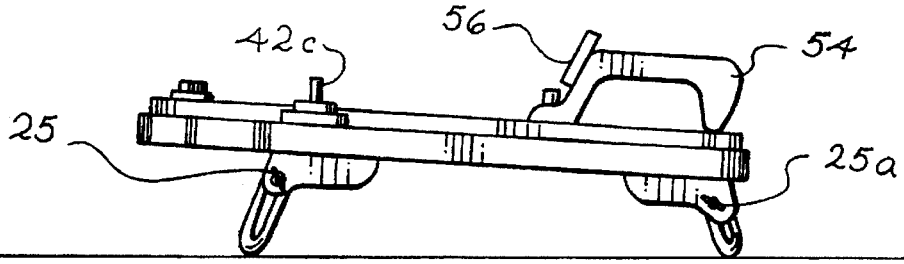
FIG. 3 is a side elevational view of the cutter work guide.

Referring to FIG. 3, the shingle cutting guide 10 of this invention is mounted on a flat surface, illustrating the unequal length of the device's legs 25 so that its cutting surface is slanted to allow roofing shingle particles to fall off the base member 20 between the discs 40*a–m*. In the preferred embodiment the device has adjustable legs 26 to accommodate the varying slopes of different resting surfaces, including roofs.

In its operation the cutter work guide 10 is placed on a flat surface with the second side 24*b* lower than the first 24*a*, such that the apparatus slopes downward toward the second side as shown in FIG. 3. After a roofing shingle is placed on the surface of the base plate 20, the cutting guide is set at its predetermined position by fixing it in place with the appropriate locator pins 42. The pins may fix the guide 50 in place by locking it between them. Alternatively, the pins may be positioned into a hole 52 in the guide. The shingle is cut by running the blade of a cutting knife along the cutting guide 50.

What is claimed is:

1. A cutter work guide, for roofing shingles, comprising:

a. a substantially rectangularly shaped, generally flat, base member having first and second sides and two ends;

b. a plurality of discs arranged in a row, spaced and fixedly attached along and parallel to the first side, having substantially upright surfaces for guiding a roofing shingle;

c. a guide member for guiding a cutting tool, said guide member being pivotally attached to the base member near the second side;

d. a plurality of locator pins fixedly attached to the base member, which serve to fix the guide member at predetermined angles relative to a longitudinal axis of the base member; and e. a handle pivotally attached to the guide member.

2. The cutter guide of claim 1 wherein the base member has a plurality of graduated measurements extending along the second side of the base member.

3. The cutter guide of claim 1 wherein the handle on the guide member has a substantially upright member which serves to protect a hand of an operator during a cutting operation.

4. A cutter work guide for roofing shingles, comprising:

a. a substantially rectangularly shaped, generally flat, base member having first and second sides and two ends;

b. a plurality of discs arranged in a row, spaced and fixedly attached along and parallel to the first side, having substantially upright surfaces for guiding a roofing shingle;

c. a guide member for guiding a cutting tool, said guide member being pivotally attached to the base member near the second side;

d. the guide member having a handle fixedly attached thereto;

e. a plurality of locator pins fixedly attached to the base member to fix the guide member at predetermined angles relative to a longitudinal axis of the base member;

f. a plurality of graduated measurement marks extending along the second side of the base member; and g. a lateral extension from the second side, the extension having an opening, the extension with the opening serving as a carrying handle.

5. The cutter work guide of claim 4 wherein the handle on the guide member has a substantially upright member which serves to protect an hand of a operator during a cutting operation.

6. The cutter work guide of claim 4 wherein the guide member is pivotally attached to the lateral extension of the base member.

* * * * *